United States Patent [19]

Stoner et al.

[11] 4,285,796

[45] Aug. 25, 1981

[54] ELECTROLYSIS ELECTRODE

[75] Inventors: Glenn E. Stoner; George L. Cahen, Jr., both of Charlottesville, Va.

[73] Assignees: The University of Virginia, Charlottesville, Va.; Research Corporation, New York, N.Y.

[21] Appl. No.: 935,155

[22] Filed: Aug. 21, 1978

[51] Int. Cl.[3] ..... C25B 11/02; C25B 11/04

[52] U.S. Cl. ..... 204/290 R; 204/1 T; 204/195 B; 204/290 F; 204/294

[58] Field of Search ..... 204/290 R, 290 F, 294, 204/195 B, 1 E

[56] References Cited

U.S. PATENT DOCUMENTS

| | | | |
|---|---|---|---|
| 3,484,183 | 12/1969 | Dickson et al. | 8/116 |
| 3,560,265 | 2/1971 | Craig | 429/29 |
| 3,725,226 | 4/1973 | Stoner | 204/149 |
| 3,798,063 | 3/1974 | Decraene | 428/328 |
| 3,853,739 | 12/1974 | Kolb et al. | 204/290 F |
| 3,881,957 | 5/1975 | Hausler | 204/290 R X |
| 3,923,629 | 12/1975 | Shaffer | 204/260 |
| 3,948,745 | 4/1976 | Guilbault et al. | 204/195B |
| 3,968,273 | 7/1976 | Kastening et al. | 427/122 |
| 4,016,044 | 4/1977 | Fresnel et al. | 204/1 E X |
| 4,098,669 | 7/1978 | DeNora et al. | 204/252 |
| 4,102,759 | 7/1978 | Gerber et al. | 204/94 |
| 4,118,294 | 10/1978 | Pellegri | 204/129 |

*Primary Examiner*—F. Edmundson

*Attorney, Agent, or Firm*—Oblon, Fisher, Spivak, McClelland & Maier

[57] ABSTRACT

An electrode, which comprises an electrically conductive current collector, and a working surface containing a multiplicity of conductive islands in a non-conducting matrix wherein the majority of said islands are in electrically conductive contact with said current collector wherein the average size of said conductive islands and the average spacing between said conductive islands are of the same order of magnitude as the diffusion layer of the solution intended to be treated when said electrode is immersed into said solution.

4 Claims, 6 Drawing Figures

ELECTROLYSIS ELECTRODE

BACKGROUND OF THE INVENTION

1. Field of the Invention

The present invention relates to an electrolysis electrode of relatively low effective electrode area per unit of geometric surface area of the electrode.

2. Description of the Prior Art

Carbonized or graphitized materials have been employed in the past in a variety of forms as conductors for electrical current. Thus, for example, anodes for use in electrolytic cells which in turn are used for the electrolysis of brine to chlorine and caustic and for the electrolysis of $Na_2SO_4$ to caustic and sulfuric acid and the like have been prepared by compressing vermicular graphite to a relatively high density. Anodes of improved mechanical properties have been formed by blending an inorganic or organic bonding agent such as polyethylene, ethylene-propylene copolymers, polyurethane resins or the like with the vermicular graphite.

It is also known that black fibers and fabrics can be formed which have both insulating and electrical conductivity characteristics as disclosed in U.S. Pat. No. 3,484,183. The carbonized material is formed by impregnating a fabric or fibers of regenerated cellulose (rayon) with a water-soluble monobasic metal phosphate salt, and then heating the fabric or fibers to carbonize the same. The degree of electrical conductivity of the carbonized fabric or fibers can be controlled by the manner in which the continuous filament strands are aligned in a pressure sensitive-adhesive tape structure.

Most of the electrodes of the prior art require relatively high power input, which is now believed to be a result of the high and inefficient current density required of the electrode surface. In a conventional Pt electrode, the entire surface of the electrode is conductive, which means that a larger area must be energized than is often needed for a particular use which is wasteful of power.

U.S. Pat. No. 3,923,629 shows an electrolytic cell in which a series of water permeable electrodes are formed of a material, such as graphite or carbon fabric, over which an alternating potential is impressed on the order of about 0.1 to 20 volts as contaminated water is passed through the cell. However, because of their porous nature, the electrodes easily clog, and because of the increased surface area, require a high total current. They also permit many useless spaces to form within the porous matrix of the electrodes.

A need exists for an electrolysis electrode which requires less power input as a result of a more efficient electrode area per unit geometric area of the electrode.

SUMMARY OF THE INVENTION

Accordingly, it is one object of the present invention to provide an electrode of low power requirements.

It is another object of this invention to provide an electrode of low power requirements which can be used for inactivation of pathogens in water.

It is a still further object of this invention to provide an electrode which enhances the diffusion of reactants to the electrode surface.

These and other objects of the present invention as hereinafter will become more readily apparent from the following description can be achieved by an electrode which comprises an electrically conductive current collector, and a working surface containing a multiplicity of conductive islands in a non-conducting matrix wherein the majority of said islands are in electrically conductive contact with said current collector wherein the average size of said conductive islands and the average spacing between said conductive islands are of the same order of magnitude as the diffusion layer of the solution intended to be treated when said electrode is immersed into said solution.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 3:
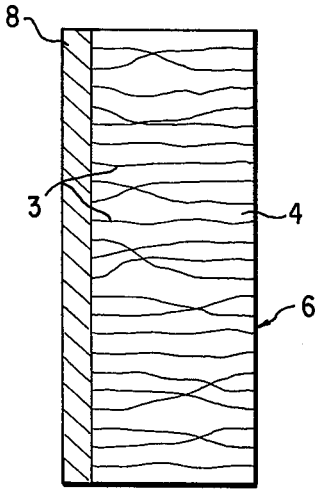
FIG. 3 is a cross-sectional view of a second embodiment of a fiber composite electrode according to the present invention.

The present invention refers to electrodes for use in electrolysis processes. In particular, the electrodes of this invention are contemplated for use in effecting electrolytic reactions in aqueous or non-aqueous solutions. For instance, these electrodes could be used for disinfection of aqueous media as discussed in Stoner, U.S. Pat. No. 3,725,226, or they could be used for oxidizing or reducing of compounds in solutions, etc. In these types of reactions, a reactive species which is to be electrolytically oxidized or reduced must diffuse to the surface of the electrode where electron interchange occurs. The oxidized or reduced species must then diffuse away from the surface to permit continuation of the reaction. Along the surface of an electrolytic electrode, a boundary diffusion layer of relatively quiescent fluid will of course be present, and it is through this boundary layer that the reaction species must diffuse to contact the electrode surface. The diffusion layer, as is well known, is formed by the physical forces between the solid electrode surface and the bulk solution and its thickness is dependent upon many factors including viscosity of the fluid, temperature, and wettability of the solution for the electrode surface.

In the ordinary electrolysis electrode, the conductive surface of the electrode is continuous and congruent with the diffusion layer boundary on the electrode surface. Reactive species diffuse through the boundary diffusion layer at every point and the oxidized or reduced species diffuse out through the diffusion layer at every point.

In contrast, in the electrode of the present invention, the conductive surface of the electrode is highly discontinuous. While diffusion of the reactive species in solution occurs across the diffusion layer, the discontinuous nature of the specific points of conductivity or "conductive islands" on the surface of the electrode ensures that at each conductive island hemispherical diffusion of reactants into and products from the conductive surface occurs. By having the average size of these conductive islands approximate in thickness the diffusion layer in the solution intended to be treated, the quantity of reactants which diffuses to the conductive surface will more closely correspond to the capacity of the conductive surface for effecting electrolysis of the reactants at the surface. The net result is that electrolysis will occur at maximum efficiency. In ordinary electrodes, an imbalance normally exists between the rate of diffusion of the reactive species and the capacity of the electrode surface for effecting electrolysis of the reactants. This results in decreased electrolysis efficiency and in the occurrence of secondary or tertiary reactions.

The electrode of this invention is characterized by a working electrode surface having a multiplicity of conductive portions, or islands, which are separated by a non-conducting matrix.

The matrix may be any non-conductive, relatively non-porous thermoplastic or thermosetting resin, such as epoxy resins, polyamides, polyesters, polyphenylene sulfide, polyphenylene oxide, polysulfones or the like. Alternatively, the matrix may be a non-resinous material such as glass, silica, alumina, ceramic, non-conducting alloys or any other non-conductive material, such as natural or synthetic rubber. The only requirement of the non-conducting matrix is that it should not be soluble in water or organic solvents to which the electrode is expected to be exposed.

The conductive islands on the working surface may be made of any conductive material including conductive metals or graphite.

The conductive islands are sized such that they approximate the order of magnitude of the diffusion layer of the solution in which the electrode is to be used. They are spaced about the same distance apart.

In one embodiment, the conductive islands have an average diameter of 3–30 μm and are spaced apart an average distance of 3–50 μm.

The quantity of islands over the surface are such that the conductive portion of the surface is dependent upon the size of working surface needed. Areas of 30–60% of conductive islands based on the total surface have been found to be suitable when the electrode is contemplated for use for disinfection of aqueous solutions.

Since the thickness of the diffusion layer is dependent upon many factors, as discussed above, of course the critical size of the conductive islands, spacing of the islands and area over the surface will be variable and will depend only on the conditions of ultimate expected use of the electrode.

If the spacing between the conductive islands on the average is too narrow, the effect will be a loss of electrolysis efficiency since the functioning of the electrode will then be similar to the ordinary bulk, continuously conductive electrode. As the spacing between islands increases, the available electrolytic surface, is, of course, reduced, and efficiency will be decreased. In general, the spacing between islands should approximate the size of the islands themselves.

Accordingly, the total conductive area of the conductive portions exposed at the working surface ranges from 30–60% of the total working surface area. Thus, for conductive portions whose diameter or cross-sectional distance ranges from 3 to 30 μm, the center-to-center distance between adjacent conductive portions is 3.0 to 50 μm.

A substantial portion or all of the conductive islands should be in electrical contact with a current collector. Leads can be provided from the conductive islands to the collector, or the islands can be made from a unitary body with the collector. For instance, one very convenient way of simultaneously creating the conductive islands and to provide points of electrical contact with a collector is to embed a multiplicity of electrically conductive fibers in a non-conductive matrix. Conductive fibers of metal or graphite can be embedded in a mold of an epoxy resin or other non-conductive moldable material. By shearing one layer of the mold, fiber protrusions at the sheared surface can act as the conductive islands. If the loading of the fibers in the resin is sufficiently great, the fibers within the mold will make sufficient point-to-point contact such that most of the exposed fiber tips will be in electrical contact from the sheared surface to the opposite surfaces of the mold. A collector plate or screen of a suitable conductive material can then be placed against one of the opposite surfaces. Alternatively, a metal or graphite can be electrolytically or electrolessly plated onto one or more of the opposite surfaces and attached to a voltage source lead so as to function as a collector.

Another method of producing the electrode would be to photoetch a series of islands using ordinary photoresist procedures, onto a conductive metallic base. The islands created by photoresist techniques are then surrounded with a non-conductive coating. Leads to a voltage source are attached to the base and only the working surface of the electrode, i.e., that containing the conductive islands, is permitted to be exposed to the working fluid.

The electrodes of the present invention can be employed for any of the purposes for which electrodes are normally used in electroanalytical or electrochemical cells. A particularly important use of the electrode of the present invention is for the disinfection of aqueous solutions which are placed in an electrochemical cell. When the proper alternating current is impressed across the electrodes of the cell, microorganisms in the solution are inactivated. The electrode of this invention, however, can achieve disinfection of microorganisms at frequencies of greater than 1.0 Hz.

Figure 1:
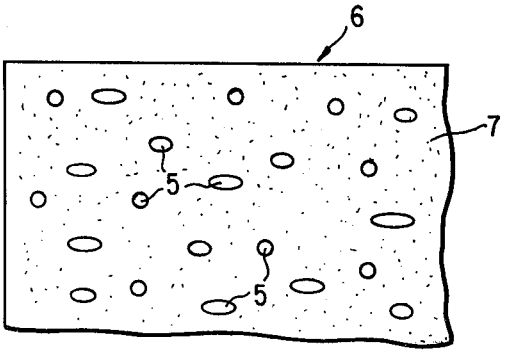
FIG. 1 shows a top view of a working electrode surface according to the present invention.

The electrode of the present invention can therefore be visualized as an array of smaller electrodes which all exist on the same surface or plane, as can be seen by reference to FIG. 1. FIG. 1 shows a view of a working surface 6 in which conductive islands 5 are surrounded by a non-conductive matrix 7. All of those conductive islands 5 which are in electrical contact with the current collector 8 in FIG. 2 will function as small electrodes in a planar array.

The size of each of these "small" electrodes or conductive islands is of the same order as the diffusion layer of solution into which the electrode is expected to be introduced. Thus, when the conductive islands are of a diameter of about 3 to 30 μm, they will be of the same order as the thickness of the diffusion layer of most aqueous solutions at the surface of the electrode when the electrode is immersed in solution. The important factor is not so much the numerical limitations of the size of conductive islands, but rather that the size of islands should be of the same order of magnitude as the thickness of the diffusion layer of the expected working solution. This characteristic means that the present electrode exhibits the advantage of hemispherical diffusion from a point as opposed to planar diffusion. The hemispherical or radial diffusion provides an effective mass transfer (diffusion) coefficient which is greater than can normally be achieved with conventional electrodes. This type of diffusion results in better mixing and more efficient electrolysis, since products of electrolysis diffuse as if from point sources into the bulk solution giving rise to greater diffusion properties.

The preferred electrode embodiment of the present invention is a fiber composite electrode which is composed of a planar array of electrically conducting fibers embedded in a non-conducting matrix, such that the fibers make electrical paths which traverse the body of the electrode from the working surface to another surface of the electrode.

In this embodiment the electrode is formed by embedding a multiplicity of fibers into a non-conducting matrix and then shearing one surface to expose a plurality of protruding fibers. If the loading of fibers within the matrix is sufficiently high, a sufficient number of electrical paths will traverse the width of the body to the current collector.

Usually, from 30–60 vol.% conducting fibers are blended with a matrix material to form the composite electrode. The matrix material may be any of those discussed above. Suitable conducting fibers are formed of materials which include any form of carbon such as graphite, carbonized fibers derived from pitch and acrylonitrile based homopolymers and copolymers or the like; noble metals such as platinum, gold, silver, or the like; conducting metal alloys or conducting metal oxides. Many techniques are well known for the formation of carbon and graphite fibers and any of these techniques can be employed to form conducting fibers which are useful in the preparation of the present electrodes. The diameter of the present conducting fibers normally ranges from 3 to 30 μm, preferably 3–22 μm, while the length of the fibers usually ranges from ⅛ inch to 1 inch.

The fiber formed electrodes can be prepared by any one of a number of conventional techniques. Individual fibers may traverse the body of the electrode from working surface to current collector, but this is not a mandatory requirement. In the usual instance, the fiber orientation in the non-conductive matrix (usually polymeric or plastic matrix) will be more or less random, but if the loading is sufficient, a sufficient number of fibers will touch one another to create conductive paths. In order to ensure homogeneous current density throughout the electrode, a current collector is placed on the surface of the electrode other than the working surface where the fiber termini surface. The material from which the current collector is formed is not critical in that it can be of any material of very low electrical resistivity such as any electrically conductive metal including copper, nickel, tin, the noble metals, metal alloys and even conductive metal oxides. The current collector can be placed on the electrode by any convenient technique, such as by plating by such techniques as electroless plating, sputtering or the like. The current collector could also be mechanically connected to the electrode or the current collector can be a close wire net or screen which is embedded at or beneath the current collector surface of the electrode thereby ensuring intimate contact between the conducting fibers and the wire net. The thickness of the collector is not important and need only be thick enough to provide efficient current collection. Usually the thickness of the collector is greater than 10 μm.

Figure 2:
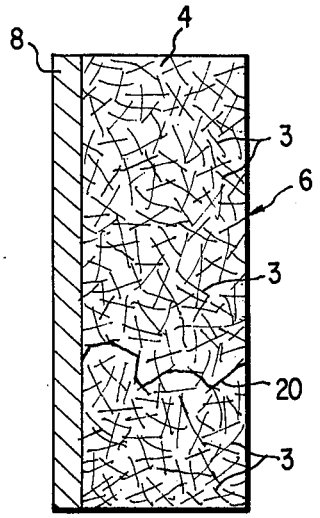
FIG. 2 is a cross-sectional view of one embodiment of a fiber composite electrode of the present invention.

FIG. 2 shows a typical representation of the structure of a fiber composite electrode within the scope of the present invention wherein conducting fibers 3 are distributed in polymer matrix 4 in a random pattern creating conductive paths, emphasized by line 20. If desired, the fibers can be oriented so that the great majority traverse from the working surface to the collector 8, as shown in FIG. 3. This configuration can be obtained by simply taking a tow of the proper amount of conducting fibers and binding the fibers in a molten polymer or plastic. The shape of the electrode can be formed by molding or by suitable and conventional mechanical shaping means. In another technique it is possible to predeposit or encase a small amount of polymer about individual conducting fibers and then combine a number of the encased fibers into a unit. Thereafter, the polymer coatings about the massed fibers are melted so that all of the fibers are encased in a unitary polymer mass.

If the end of a fiber tip forming the conductive island protrudes the surface from a perpendicular angle to the surface the conductive island found will be the same as the cross-section of fiber. If the fiber has a circular cross-section in this instance, then the conductive island will be circular. If the angle of the fiber protruding the surface is not perpendicular, the cross-section of the resulting conductive island will appear to be more elliptical.

The working surface of the electrode will thus only consist of those smaller number of fibers whose tips penetrate the working surface 6 and which is in electrical contact with the collector 8.

The surface features of the fiber formed electrodes of the present invention relative to the conductive characteristics of the electrodes can be considered from another point of view which does not involve solution parameters. Normally, the loading of fibers in the non-conducting matrix ranges from 30–60 vol.%. This means that the total conducting area of the fibers at the working surface is the same as the percent volume loading or 30–60%. Thus, for fibers having a diameter or cross-sectional distance of 3 to 30 μm at a conductive area of 30 to 60%, the fiber-to-fiber distance (from center of fiber to center of fiber) ranges from 3.0 to 50 μm. When the smallest diameter fibers are employed, i.e., 3 μm, at the highest volume loading, i.e., 60%, which represents one extreme configuration of the electrode, the fiber to fiber distance (center of fiber to center of fiber) is 3.43 μm. This means that the distance between adjacent fibers from periphery to periphery is 0.43 μm. In the other extreme configuration of the electrode wherein the largest diameter of fibers of 30 μm are present in the matrix material at the lowest level of loading, i.e., 30%, the fiber to fiber distance is 48.5 μm. In this situation, a distance of 18.5 μm separates individual fibers from one periphery to another.

One of the very interesting variations of this invention is to use the non-conductive matrix surface to immobilize enzymes. Enzymes can be entrapped, or covalently bonded to the surface using glutaraldehyde or diazo linking agents. The electrode can then be used for effecting enzymatic and electrolytic reactions simultaneously.

The electrode of the present invention can be used in almost any electroanalytical, electrolytic or electrochemical process where the electrical characteristics of the electrode would be advantageous. The present electrode is particularly effective in view of its power characteristics for use as the electrodes, particularly also as the bipolar electrode, in an electrochemical cell where an alternating current is impressed across a pair of fiber composite electrodes for the inactivation of microorganisms in the water medium in the cell as disclosed in copending Application Ser. No. 875,513. As discussed earlier, it is also possible that the present fiber composite electrode can be adapted to form individual multi-functional electrodes in which the non-conducting matrix can contain an enzyme, for instance, or another array of electrodes which are specific to another reaction. Consequently, in this particular case the electrode can be used to conduct parallel and series reactions on the same surface.

Figure 4:
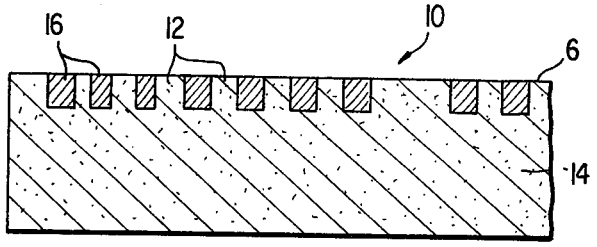
FIG. 4 is a cross-sectional side view of one embodiment of the present electrode in which the conduction portions and current collector are formed from the same mass of conductive material.
Figure 5:
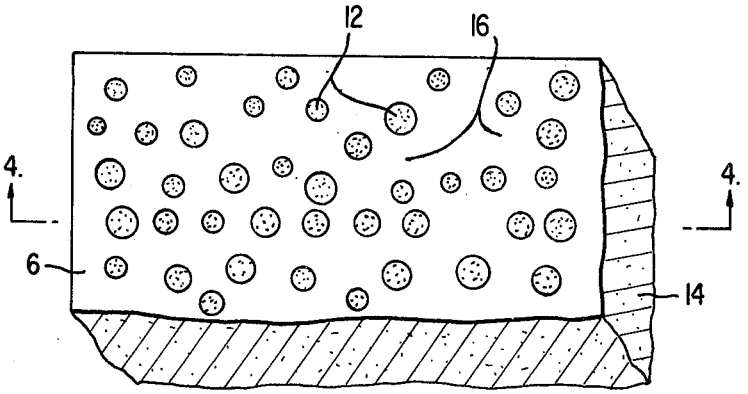
FIG. 5 is a top view of the working surface of the electrode shown in FIG. 4.

Another configuration of the planar array electrode of the present invention can be appreciated by reference to FIGS. 4 and 5. FIG. 4 is a cross-sectional side view of an electrode 10 in which conductive islands 12 are formed on one surface of conductive block 14. Block 14 can be formed of any electrically conductive metal which is inert to or not corroded by the solution in which the electrode is to be immersed. Suitable metals for the purpose include the noble metals. The open spaces between conductive islands 12 are filled with non-conducting matrix material 16 thereby forming a layer on the conductive block or current collector 14 through which the conductive islands protrude to define the working surface 6. FIG. 5 is a top view of the electrode showing working surface 6 of the fiber-like projections 12 dispersed throughout matrix material 16.

Figure 6:
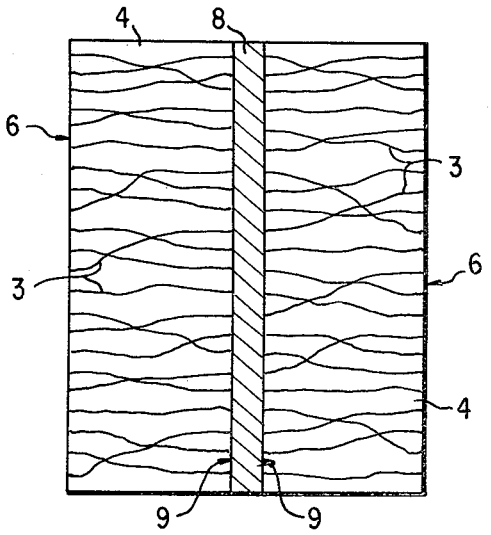
FIG. 6 is a cross-sectional view of the present electrode having two working surfaces in contact with a common current collector.

Yet another configuration of the electrode of the present invention provides for the conductive attachment of two or more working surfaces in contact with a common current collector. An embodiment of this aspect of the invention is shown in FIG. 6 wherein the meanings of the various symbols shown are the same as described for FIGS. 1–3. FIG. 6 shows two blocks of fibers 3 distributed throughout a polymer matrix 4 wherein the non-working surface 9 of each block abuts common current collector 8. In this configuration of the electrode two blocks of material can be spaced apart and then the current collector can be deposited in the open space between the blocks. Of course, other convenient ways of forming such an electrode can also be readily envisioned.

Having generally described this invention, a further understanding can be obtained by reference to certain specific examples which are provided herein for purpose of illustration only and are not intended to be limiting unless otherwise specified.

ELECTRODE OF CARBON FIBERS IN A THERMOPLASTIC RESIN

Carbon fibers derived from polyacrylonitrile (PAN) of a length of 0.25 inch and of a diameter of about 20 μm were blended in granular nylon in an amount of 40% by weight. The blend was then injection molded at a temperature above the melting point of nylon and formed into a plaque of 6"×8"×⅛" dimensions or into the shape of discs having dimensions of four inches in diameter with a thickness of ⅛ inch or a diameter of two inches with a thickness of ¾ inch.

Small rectangular shaped objects which were to be used as electrodes were then cut from the plaque. Electrodes were formed by placing a current collector on one side of each rectangular shaped object. This was done by softening the nylon body and then impressing a nickel screen onto one surface or a surface of the object was coated to a depth of about 25 μm (0.001/inch) with nickel from a nickel electroplating bath. Prior to electroplating the object, masking tape was applied to the object to prevent Ni deposition in undesired areas. The nickel containing bath contained 70 ounces of nickel sulfonate per gallon and is sold under the tradename of Lectro-Nic manufactured by Sel-rex Co. Plating was conducted from the bath having a pH of 3.0 at a temperature of 55° C. and a current density of 40 amps/ft$^2$ (43 mamps/cm$^2$). A dissolving nickel anode was used in the cell and the anode to cathode surface area ratio was 2:1. Electrode construction was completed by attaching a conductive lead such as a copper wire to the current collector.

ELECTRODE OF CARBON FIBERS IN A THERMOSETTING RESIN

Carbon fibers (Thornel-300) derived from pitch of a length of about 0.25 inch and a diameter ranging from 3 to 22 μm were mixed in an amount of 48% by volume with a standard grade epoxy resin identified as EM Grade epoxy marketed by U.S. Polymeric Corp. to form beads of resin containing and coated with carbon fibers. An amount of the resin beads sufficient to form plaque and disc shaped objects of the size described above was compression molded under heat. The epoxy was cured at a temperature of about 300° F. The plaque or disc obtained by the compression molding process was cut or machined into the desired shaped object. Rectangular shaped objects were provided with current collectors in the ways discussed above to form electrodes.

USE OF A FIBER COMPOSITE ELECTRODE IN AN ELECTROCHEMICAL APPLICATION

Two different electrochemical cells were tested for their ability to disinfect twin contact lenses which were supported between two mating conducting supports for the lenses thereby resulting in a cell which contained two bipolar electrodes. The pertinent data for the two tests are as follows:

| ELECTRODE MATERIAL: | BULK GRAPHITE | FIBER COMPOSITE |
|---|---|---|
| Treatment solution: | Normal saline | Normal saline |
| Voltage: | 10.5 V | 6 V. |
| Current Density (AC): | 30 mA/cm$^2$ | 12 mA/cm$^2$ |
| Initial orga. population (plate count): | $10^5$ *Pseudonomas* | $10^5$ *Pseudonomas* |
| After 3 minutes (plate count) | — | 0 |
| After 5 minutes (plate count) | 0 | — |

The bulk graphite electrode used in the comparative tests was formed from anode grade graphite free of resin binder supplied by Union Carbide. The fiber composite electrode employed in the tests was one of the electrodes described above in which carbon fibers were embedded in a nylon matrix to the current collector of which was attached a conductive lead. Identical results were obtained multiple times in both treatment cells both with and without contact lenses in place. Generally, when bulk graphite electrodes were used, good disinfection was obtained at current densities ≧20 mA/cm$^2$ with cell voltages of ≧2V. However, when the graphite fiber-polymer composite electrode is used, good disinfection can be achieved at current densities as low as 4 mA/cm$^2$ with cell voltages of about 2 volts. Thus, when fiber composite electrodes are used in the electrochemical disinfection of various devices, there is a significant gain in energy efficiency of the cell.

Having now fully described this invention, it will be apparent to one of ordinary skill in the art that many changes and modifications can be made thereto without departing from the spirit or scope of the invention set forth herein.

What is claimed as new and intended to be secured by letters patent is:

1. An electrode, which comprises:

an electrically conductive current collector; and a working surface containing a multiplicity of conductive islands in a non-conducting matrix wherein the majority of said islands are in electrically conductive contact with said current collector wherein the average size of said conductive islands ranging from 3–30 μm and the average spacing between said conductive islands ranging from 3–50 μm are of the same order of magnitude as the diffusion layer of the solution intended to be treated when said electrode is immersed into said solution, said surface having fixed thereto on the non-conducting matrix thereof, an enzyme, thereby rendering said electrode capable of simultaneously effecting enzymatic and electrolytic reactions.

2. The electrode of claim 1, wherein said non-conducting matrix is a thermoplastic or thermosetting resin.

3. The electrode of claim 1, wherein the total conductive area of said electrode is 30–60% of the total working surface, and wherein the average cross-sectional area of said islands is of the same order of magnitude as the diffusion layer of the solution intended to be treated when said electrode is immersed into said solution.

4. The electrode of claim 1, wherein said current collector is a metal film of a thickness greater than 10 μm deposited on the non-working side of said electrode.

* * * * *